US006749370B1

(12) United States Patent
Urabe et al.

(10) Patent No.: US 6,749,370 B1
(45) Date of Patent: Jun. 15, 2004

(54) BUOYANCY COMPENSATING JACKET

(75) Inventors: Seishiro Urabe, Tokyo (JP); Haruo Kawashima, Tokyo (JP); Minoru Takeuchi, Tokyo (JP); Kenji Kawana, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/384,526

(22) Filed: Mar. 11, 2003

(51) Int. Cl.[7] ..... B63B 11/02

(52) U.S. Cl. ..... 405/186; 405/185; 441/88; 441/106; 441/112; 441/136; 114/315; 114/333

(58) Field of Search ..... 405/185, 186, 405/187; 441/88, 108, 106, 111, 112, 136; 114/315, 331, 333

(56) References Cited

U.S. PATENT DOCUMENTS

| | | | | |
|---|---|---|---|---|
| 2,982,105 A | | 5/1961 | Akers | |
| 3,135,098 A | | 6/1964 | Root | |
| 3,263,432 A | | 8/1966 | Maskell | |
| 3,670,509 A | | 6/1972 | Walters | |
| 3,842,611 A | | 10/1974 | Anderson | |
| 3,877,098 A | | 4/1975 | Braly | |
| 4,016,616 A | | 4/1977 | Walters | |
| 4,440,525 A | | 4/1984 | Perla | |
| 4,608,940 A | | 9/1986 | Bulin | |
| 4,778,307 A | | 10/1988 | Faulconer | |
| 4,779,554 A | | 10/1988 | Courtney | |
| 4,877,167 A | | 10/1989 | McNemar | |
| 4,887,932 A | | 12/1989 | Toth | |
| 5,085,163 A | | 2/1992 | VanTassel et al. | |
| 5,205,672 A | | 4/1993 | Stinton | |
| 5,311,833 A | | 5/1994 | VanTassel et al. | |
| 5,641,247 A | | 6/1997 | Seligman | |
| 5,746,542 A | * | 5/1998 | Carmichael | 405/186 |
| 5,803,667 A | | 9/1998 | Seligman | |
| 5,860,769 A | * | 1/1999 | Seligman | 405/186 |
| 5,913,640 A | * | 6/1999 | Bortner | 441/88 |
| 5,944,450 A | * | 8/1999 | Anderson | 441/106 |
| 6,030,147 A | | 2/2000 | Bowden | |
| 6,203,390 B1 | * | 3/2001 | Elliott | 441/80 |
| 6,592,417 B2 | * | 7/2003 | Kawashima et al. | 405/186 |

FOREIGN PATENT DOCUMENTS

| | | | |
|---|---|---|---|
| FR | 2259010 | | 2/1972 |
| FR | 2590540 | | 5/1987 |
| GB | 964217 | | 3/1963 |
| GB | 1587124 | * | 4/1981 |

OTHER PUBLICATIONS

Pp. 15–18 from www.zeagle.com website (2002).
Zeagle Systems, Inc., Dive Without a Weight Belt, 1994 Catalog.

* cited by examiner

*Primary Examiner*—Jong-Suk (James) Lee
(74) *Attorney, Agent, or Firm*—Clark & Brody

(57) ABSTRACT

A buoyancy compensating jacket is provided on a waist portion with a pocket having a first flap, a pouch having a flat cord adapted to be inserted into and taken out from the pocket with a weight packed into the pouch. As a guide means for the flat cord, at least one of a substantially C-shaped guide ring provided at a distal end of the first flap substantially in the vertically middle and a groove formed on an outer surface of the pocket and/or an inner surface of the first flap substantially in the vertically middle.

7 Claims, 7 Drawing Sheets

PRIOR ART

BUOYANCY COMPENSATING JACKET

BACKGROUND OF THE INVENTION

This invention relates to a diving jacket having a buoyancy compensating function.

U.S. Pat. No. 5,641,1247 discloses a diving jacket comprising a combination of spider and buoyancy compensator provided with an insertable weight system. In this well-known diving jacket, a buoyancy compensating weight is put in an envelope provided with a flap and this envelope is, in turn, adapted to be inserted into A pocket formed on a waist band portion covering the jacket wearer's waist. The flap of the envelope is adapted to close an opening of the pocket and provided on its outer surface with a knob for hand-grip. The flap may be opened with the knob gripped by the hand to pull the envelope out from the pocket while this well-known jacket includes envelope fastening means provided within the pocket in order to prevent anxiety that the envelope might unintentionally fall off from the pocket, such fastening means makes it difficult to insert the envelope completely into the pocket.

The diving jacket 101 illustrated in FIG. 7 of the accompanying drawings is also well known. This jacket 101 comprises a pocket 102 provided with a flap 103 and a weight pouch 104 provided with a cord used to draw this pouch 104 from the pocket 102. In this jacket 101 having the pocket 102 provided with the flap 103, the pocket 102 is provided on its outer surface with a surface fastener 102*a* and the flap 103 is provided on its inner surface with a surface fastener 103*a*. These surface fasteners 102*a*, 103*a* are separably engaged with each other so that the weight pouch 104 can be put in the pocket 102 without an anxiety that the weight pouch 104 might unintentionally fall off from the pocket 102. The flap 103 of the pocket 102 closes with the cord 105 of the pouch 104 interleaved between the outer surface of the pocket 102 and the inner surface of the flap 103 so that the cord 105 may be pulled in a direction indicated by an arrow X with a hand-grip knob 106 attached to the distal end of the cord 105 held by one hand to open the flap 103 and thereby to pull the pouch 104 out from the pocket 102. However, if the cord 105 is placed aside up- or downward when the flap 105 is closed, the cord 105 will be not properly interleaved between the outer surface of the pocket 102 and the inner surface of the flap 103. In such a situation, the flap 103 can not be quickly opened even if the cord 105 is pulled and pulling out of the pouch 104 may be often retarded. In this jacket 101, a surface fastener 106a is attached to the cord 105 so that the cord 105 may be fixed to the outer surface of the pocket 102 by means of this surface fastener 106*a*. However, it is difficult to fix the cord 105 to a vertically middle area of the pocket 102 in a single procedure. In addition, after the cord 105 has been interleaved between the pocket 102 and the flap 103, there is a possibility that a gap may be left between the surface fasteners 102*a*, 103*a* in the vicinity of the cord 105 and the flap 103 may be unintentionally opened.

SUMMARY OF THE INVENTION

It is an object of this invention to improve a diving jacket so that the buoyancy compensating weight may be easily taken out from a pocket, and a fastening strength of a flap attached to the pocket may be significantly improved.

According to this invention, there is provided a buoyancy compensating jacket comprising a back portion extending in a vertical direction, a pair of shoulder portions extending downward from transversely opposite sides of an upper portion of the back portion and a pair of waist portions extending forward in a waist-circumferential direction orthogonal to the vertical direction from transversely opposite sides of a lower end portion of the back portion and connected to the shoulder portion, the back portion being provided with means adapted to fix an air cylinder and the waist portion being provided with at least one pocket extending in the waist-circumferential direction and having an opening at its forward end thereof in the waist-circumferential direction and a pouch having a flat cord and being adapted to be inserted into and taken out from the pocket with a weight packed into the pouch.

The pocket comprises a first flap extending backward in the waist-circumferential direction, a pair of surface fasteners releasably engaged with each other and provided on an inner surface of the first flap and an outer surface of the pocket respectively and a guide means provided on at least one of the first flap and the pocket so as to enable the flat cord of the pouch inserted into the pocket to extend outward from the pocket substantially in a vertically middle area on the inner surface of the first flap.

This invention includes the following embodiments.

The guide means comprises a substantially C-shaped guide ring which is provided substantially in the vertically middle area to a distal end of the first flap extending backward in the waist-circumferential direction and has an opening backward in the waist-circumferential direction. The guide ring has an inner diameter extending in the vertical direction larger than a width of the flat cord as measured in the vertical direction and the opening is smaller than the width of the flat cord.

The guide means comprises a groove defined between two sections of the surface fastener which are bisected and spaced from each other in the vertical direction on at least one of the inner surface of the first flap and the outer surface of the pocket and a dimension of the groove in a depth direction thereof is substantially equal to or larger than a thickness of the flat cord.

The guide means comprise the substantially C-shaped guide ring which is provided substantially in the vertically middle area to the distal end of the first flap extending backward in the waist-circumferential direction and has the opening backward in the waist-circumferential direction wherein the guide ring has the inner diameter extending in the vertical direction larger than the width of the flat cord as measured in the vertical direction and the opening is smaller than the width, and the groove defined between two sections of the surface fastener which is bisected and spaced from each other in the vertical direction on at least one of the inner surface of the first flap and the outer surface of the pocket wherein the dimension of the groove in the depth direction thereof is substantially equal to or larger than the thickness of the flat cord.

The pouch has an insertion opening for a weight at a forward end thereof in the waist-circumferential direction, a second flap adapted to open and close the insertion opening and the flexible flat cord extending in the waist-circumferential direction and being adapted to be guided by the guide means and provided on a distal end thereof in the waist-circumferential direction with a hand-grip extending in a transverse direction of the flat cord beyond the width of the flat cord.

The waist portion is provided with a press flap adapted to overlap an outer surface of the first flap in a closed state and extending from back to front in the waist-circumferential direction and the outer surface of the first flap and an inner surface of the press flap are adapted to be separably integrated with each other by means of a pair of surface fasteners attached to these surfaces.

DETAILED DESCRIPTION OF THE PREFERRED EMBODIMENTS

Details of the buoyancy compensating jacket according to this invention will be more fully understood from the description given hereunder in reference to the accompanying drawings.

Figure 1:
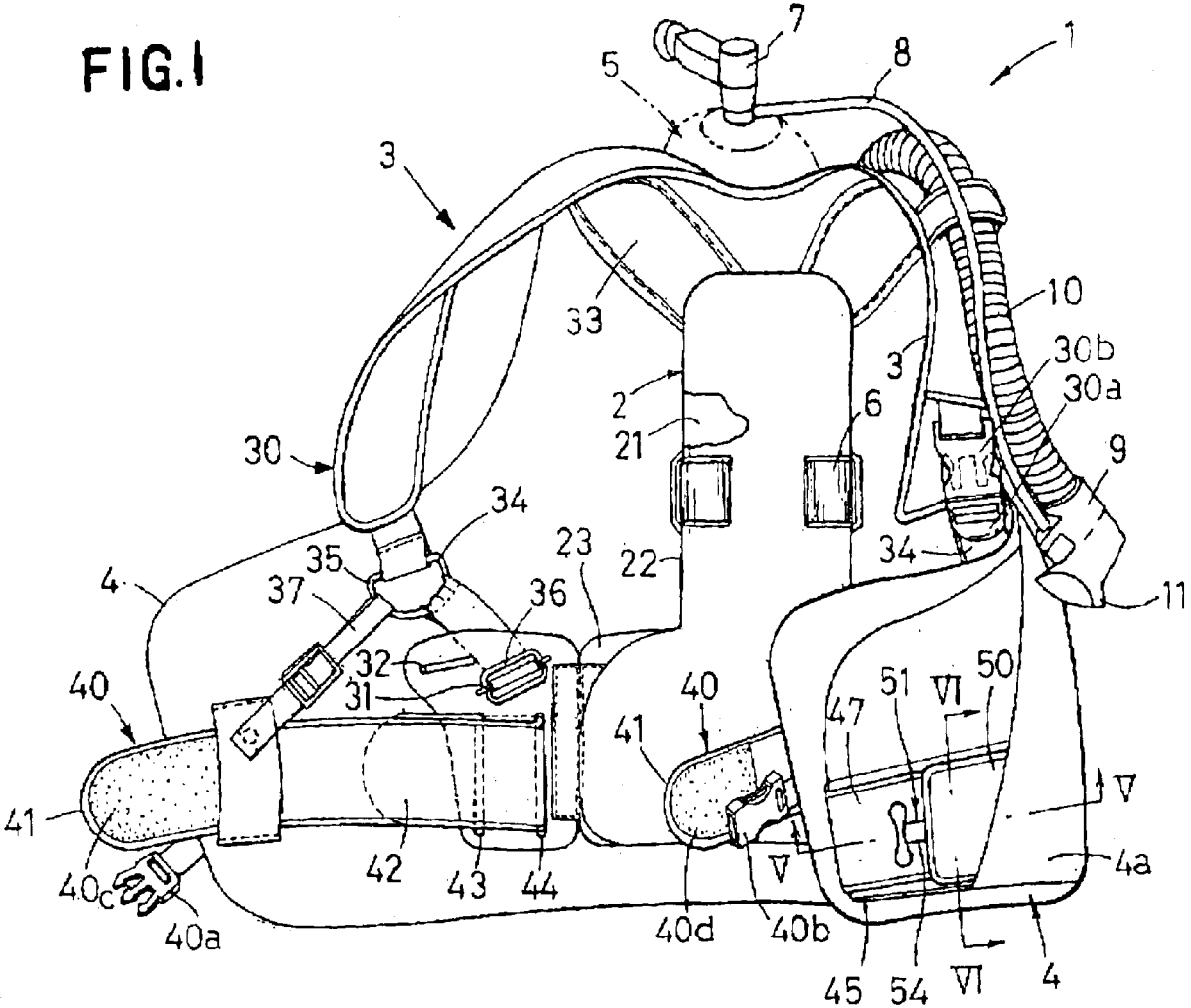
FIG. 1 is a partially cutaway front view showing a diving jacket.
Figure 2:
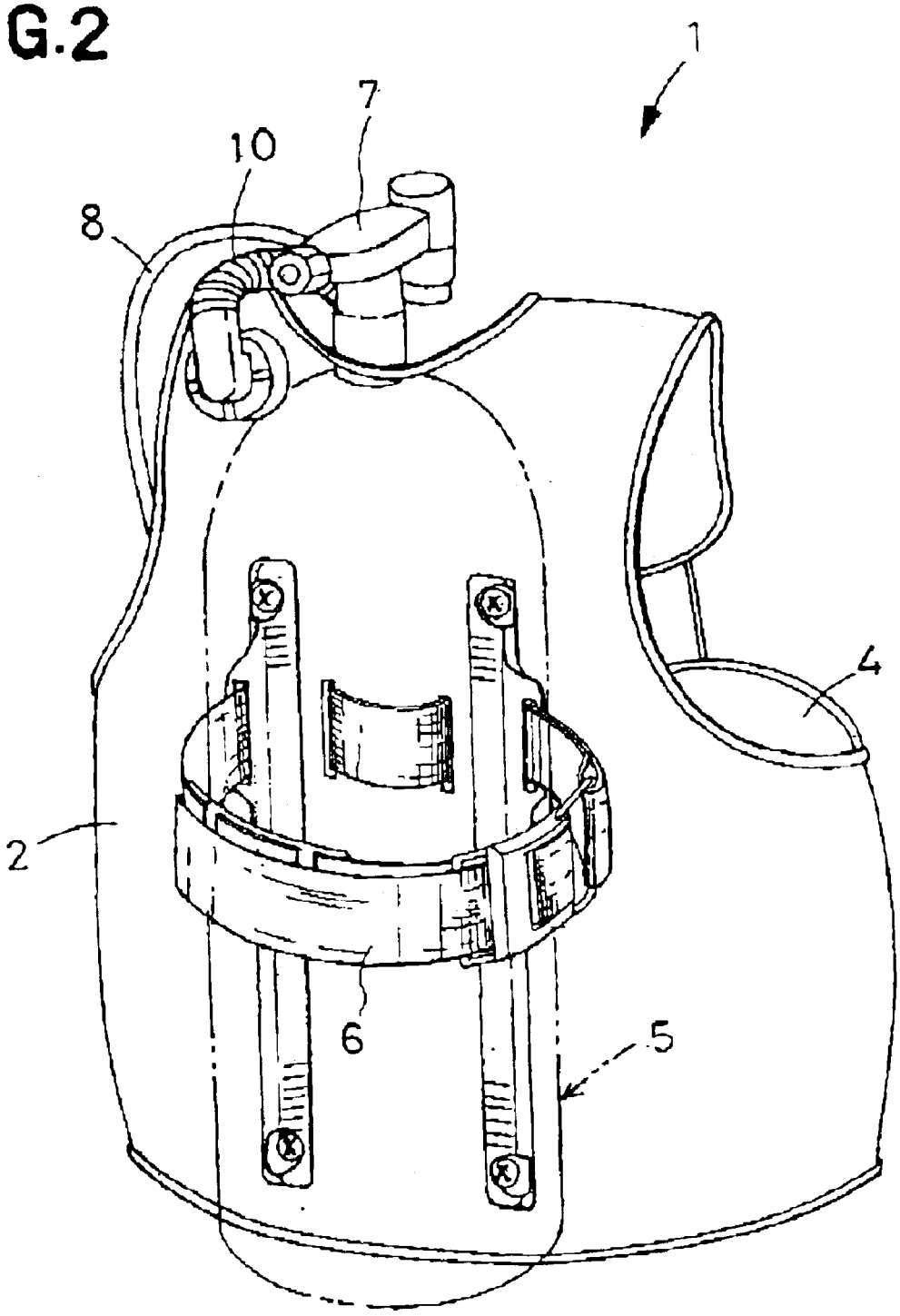
FIG. 2 is a rear perspective view showing the diving jacket.

FIG. 1 is a partially cutaway front view showing a diving jacket 1 and FIG. 2 is a rear perspective view of this jacket 1. In the FIGS. 1, 2, an air cylinder 5 fixed to the jacket 1 is indicated by imaginary lines.

The jacket 1 comprises a back portion 2 shoulder portion 3 and a waist portion 4. Buoyancy regulating air is introduced into the jacket 1 from the air cylinder 5.

The back portion 2 extends in a vertical direction and includes a back plate 21 and a cylinder band 6 serving to stabilize the cylinder 5. The cylinder 5 is equipped on its top with a first stage 7 from which a regulator hose 8 extends to a second stage 9. An inflation hose 10 extends from the second stage 9 to the back portion 2 of the jacket 1 so that the air may be introduced from the cylinder 5 into the jacket 1. The second stage 9 is provided with a mouthpiece 11.

The back plate 21 is made of rigid plastic material such as ABS resin which is substantially not deformed during use of the jacket 1 and a cushion pad 22 placed on its inner surface so as to bear directly against the jacket wearer s back. A lower end of the back plate 21 is provided on its opposite sides with connector plates 23 extending in a waist-circumferential direction orthogonal to the vertical direction of the jacket 1. The shoulder portion 3 comprises a pair of shoulder belts 30 extending downward from opposite sides of an upper end of the back portion 2. Each of the shoulder belts 30 has its upper end portion 33 fixed to the back plate 21 by means of a bolt (not shown) and its lower end portion 34 is fixed to the connector plate 23 by means of a first insertion slit 31 or a second insertion slit 32. Whether the shoulder belt 30 should be inserted into the first insertion slit. 31 or the second insertion slit 32 depends on a jacket wearer's body size. An oval stopper member 36 having a major diameter larger than a width of the shoulder belt 30 is associated operated with the first insertion slit 31 or the second insertion slit 32 in order to avoid falling off of the shoulder belt 30 from the insertion slit 31 or 32. The upper end portion 33 and the lower end portion 34 are separably connected to each other by means of male and female fasteners 30*a*, 30*b* adapted to adjust a length of the shoulder belt 30. The lower end portion 34 is branched by a D-ring 35 into upper and lower sections. A length-adjustable supporting belt 37 extending from the D-ring 35 supports the waist portion 4 of the jacket 1 from the inner side.

The waist portion 4 is provided on its inner surface with a pair of waist belts 40 extending forward from opposite sides of the lower end of the back portion 2 in the waist-circumferential direction. These waist belts 40 are flexible and easily deformable. Waist-circumferentially forward end portions 41 of the respective waist belts 40 are provided with male and female fasteners 40*a*, 40*b*, respectively, adapted to be separably connected with each other. In addition to these male and female fasteners 40*a*, 40*b*, these end portions 41 are provided with a pair of surface fasteners 40*c*, 40*d*, respectively, adapted to be releasably engaged with each other. Each of waist-circumferentially rear end portions 42 is length-adjustably fixed to the connector plate 23 by means of a third insertion slit 43 or a fourth insertion slit 44 formed with the connector plate 23 so as to extend vertically in parallel to each other. It depends on the jacket wearer's body size whether the rear end portion 42 should be inserted through the third insertion slit 43 or the fourth insertion slit 44

FIG. 1 shows the jacket 1 with the half of the waist portion 4 lying on the left side of the wearer folded so that its outer surface can be seen. The left half of the waist portion 4 is formed with a pocket 45 (See FIG. 3 also) which is closed by a first flap 47 in the state of FIG. 1. The outer surface of the first flap 47 is overlapped by a press flap 50 extending from back to forward as viewed in the waist-circumferential direction. Referring to FIG. 1, the pocket 45 contains therein a buoyancy compensating weight and flat cord 54 of the pouch 51 is partially exposed from a distal end of the press flap 50.

Figure 3:
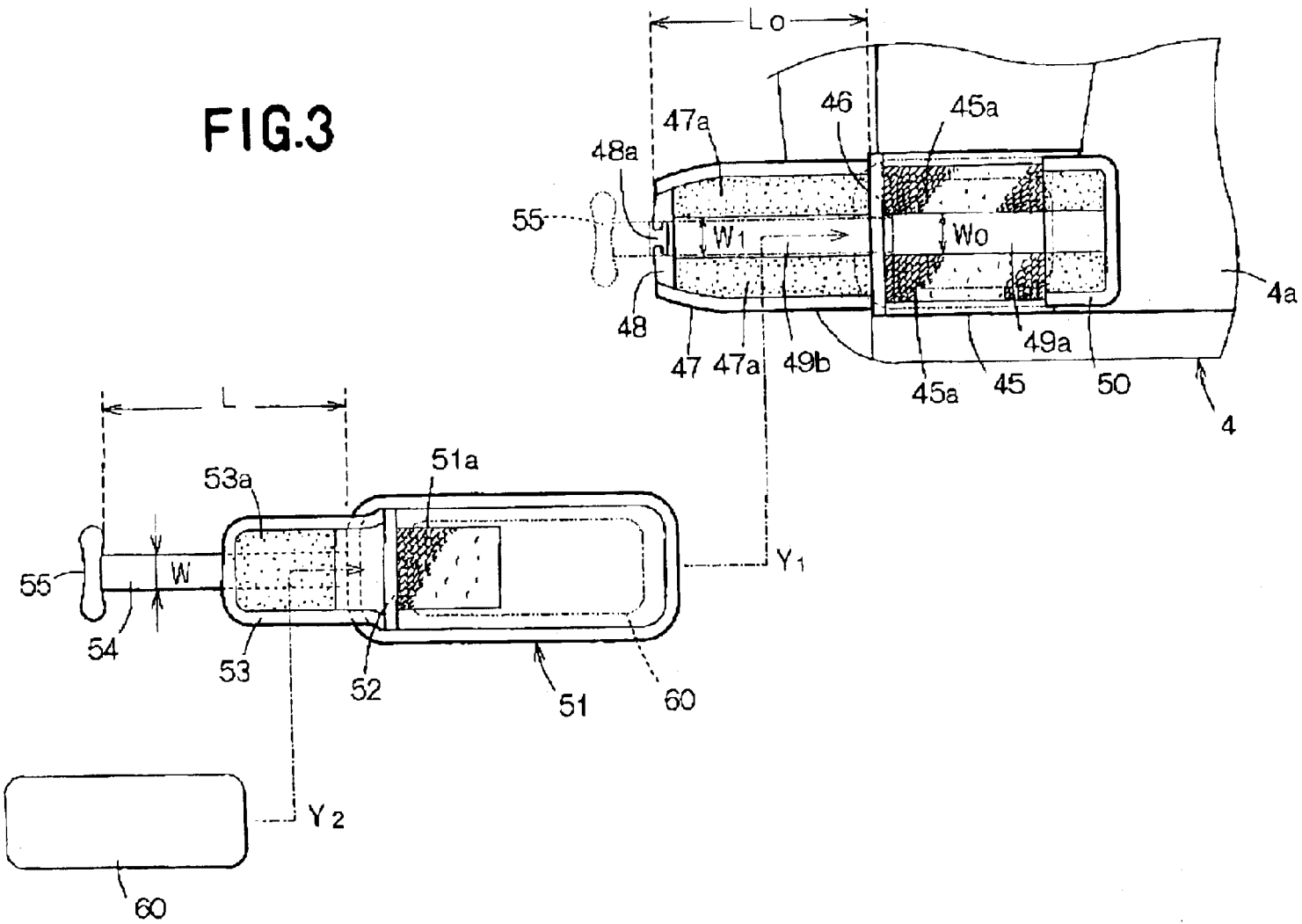
FIG. 3 is a front view showing important parts of the diving jacket.

FIG. 3 illustrates details the half of the waist portion 4 lying an the left side of the wearer as shown in FIG. 1 as well as details of the pouch 51 inserted into the pocket 45. In FIG. 3, the press flap 50 is folded backward in the waist-circumferential direction with its inner surface exposed and overlaps this half of the waist portion 4.

The pocket 45 is formed by woven fabric stitched on the outer surface of the waist portion 4. The pocket 45 extends forward in the waist-circumferential direction and has an opening 46 on a forward end thereof. In FIG. 3, the opening 46 is still no closed and the opening 46 can be closed by folding backward the first flap 47 extending from back to forward in the waist-circumferential direction. The first flap 47 is provided substantially in a vertically middle area thereof to its distal end in the waist-circumferential direction with a guide ring 48 serving as guide means for the flat cord 54 of the pouch 51. The guide ring 48 is substantially C-shaped member adapted to be opened forward when the pocket 45 is in an opened state and to be opened backward when the pocket 45 is in a closed state. The guide ring, 48 may be made of ABS, polypropylene, nylon resin, rigid synthetic rubber or the like.

The pocket 45 is provided on its outer surface with a surface fastener 45*a* having a plurality of loops while the first flap 47 is provided on its inner surface with a surface fastener 47*a* having a plurality of hooks. These surface fasteners 45*a*, 47*a* are releasably engaged with each other. The surface fastener 45*a* is bisected in the vertical direction of the jacket 1 leaving a space therebetween extending in the substantially vertical middle area of the pocket 45 and the surface fastener 47*a* is bisected in the vertical direction of the first flap 45 leaving a space therebetween extending in the substantially vertical middle area of the first flap 47. The halves of the surface fastener 45*a* and the halves of the surface fastener 47*a* are respectively spaced from each other by a distance larger than the width of the flat cord 54, resulting in that the outer surface of the pocket 45 and the inner surface of the first flap. 47 are formed with grooves 49*a,* 49*b,* respectively, extending in the waist-circumferential direction. These grooves 49*a,* 49*b* function to guide the flat cord 54 in the waist-circumferential direction and such function is effectively achieved even by only one of these two grooves 49*a,* 49*b.* Vertical dimensions of these grooves 49*a,* 49*b,* i.e., a distance $W_0$ by which the halves of the surface fastener 45*a* are spaced from each other and a distance $W_1$ by which the halves of the surface fastener 47*a* are spaced from each other are slightly larger than a width W of the flat cord 54.

The pouch 51 is provided on its front side as viewed in the waist-circumferential direction with an insertion opening 52 for the weight, a second flap 53 adapted to open and close the insertion opening 52 and the flat cord 54 extending in the waist-circumferential direction. The outer surface of the pouch 51 and the inner surface of the second flap 53 are provided with surface fasteners 51*a,* 53*a,* respectively, one of which comprises a plurality of hook members and the other comprises a plurality of loop members, wherein these hook members and loop members are releasably engaged one with another. The flat cord 54 may be made of flexible nonwoven fabric or plastic material and flexibly deformable in its longitudinal direction as well as in its transverse direction. The width W of the flat cord 54 is larger than twofold of its thickness D and a length L of the flat cord 54 extending outward from the insertion opening 52 is larger than a length $L_0$ of the first flap 47 as measured in the waist-circumferential direction. A distal end of the flat cord 54 extending in the waist-circumferential direction is provided with a hand-grip 55 extending in the transverse direction of the flat cord 54 beyond its opposite side edges. The pouch 51 is adapted to be inserted into the pocket 45 in a direction indicated by an arrow $Y_1$ with the flat cord 54 being oriented forward in the waist-circumferential direction as illustrated by imaginary lines.

A weight 60 may be lead previously adjusted to an appropriate weight and coated with plastic material, rubber or the like. The weight 60 is put in the pouch 51 in a direction indicated by an arrow $Y_2$ as illustrated by imaginary lines and then this pouch 51 is closed by the second flap 53.

Figure 4:
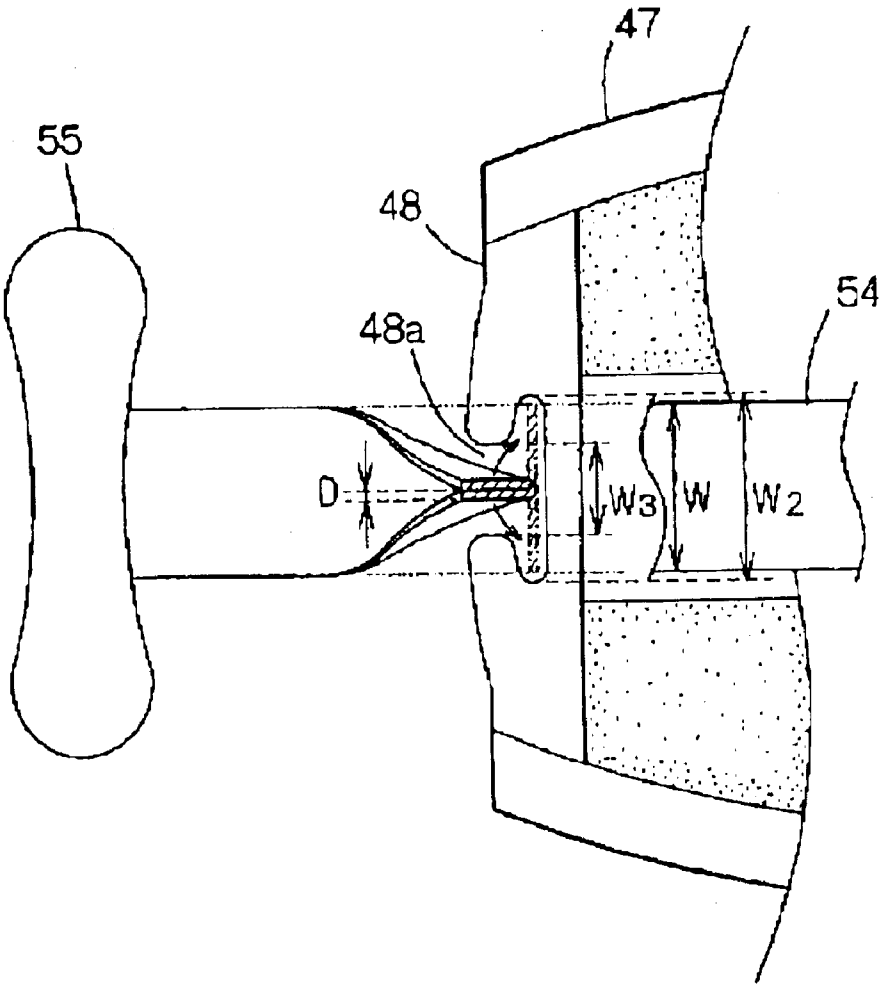
FIG. 4 is a front view showing important parts of a pocket.

FIG. 4 illustrates a distal end of the first flap 47 together with the flat cord 54 of the pouch 51. The guide ring 48 provided to the first flap 47 has an inner diameter $W_2$ corresponding to its maximum dimension in the vertical direction larger than the width W of the flat cord 54. An opening 48*a* of the guide ring 48 has a dimension $W_3$ smaller than the dimension W. It should be understood that the flat cord 54 may be folded in two in the transverse direction and thereby passed through the opening 48*a* of the guide ring 48 as indicated by solid lines in FIG. 4. Once passed through the guide ring 48, the flat cord 54 can be unfolded again in the transverse direction as indicated by imaginary lines. The width W of the flat cord 54 is larger than the dimension $W_3$ of the opening 48*a*, so it is not likely that the flat cord 54 might fall off from the guide ring 48. The guide ring 48 effectively functions to guide the flat cord 54 on the inner surface of the first flap 47 substantially in its vertically middle area.

Figure 5:
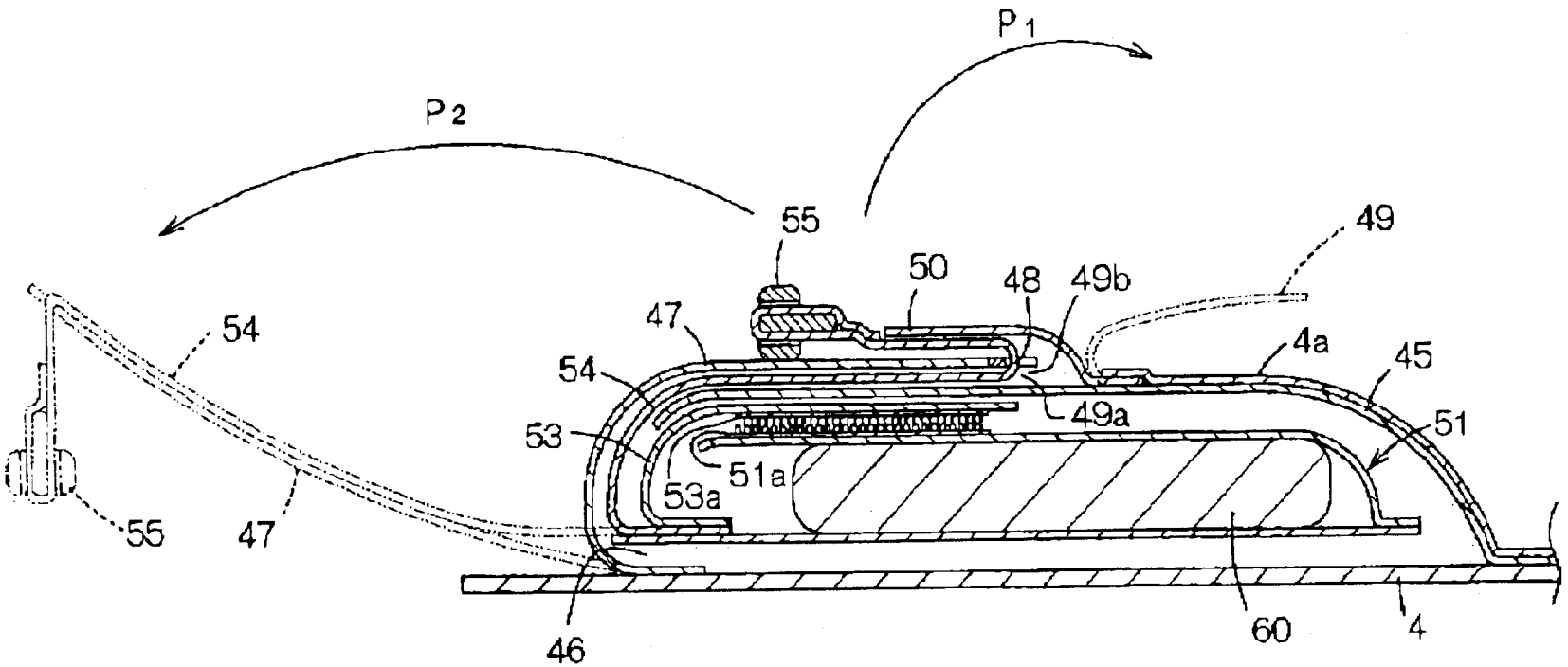
FIG. 5 is a sectional view taken along a line V—V in FIG. 1.

FIG. 5 is a sectional view taken along a line V—V in FIG. 1 extending through the flat cord 54 and the guide ring 48, illustrating important components of the pocket 45. Of this figure, the upper part corresponds to the outer side of the waist portion 4 and the right part corresponds to the front side as viewed in the waist-circumferential direction. The flat cord 54 of the pouch 51 which has been inserted into the pocket 45 extends outward from the opening 46 of the pocket 45, then is folded backward. The flat cord 54 is received in the grooves 49*a,* 49*b* formed on the outer surface of the pocket 45 and the inner surface of the first flap 47 overlying the outer surface of the pocket 45, respectively (See FIG. 6 also). The flat cord 54 extends backward in the grooves 49*a,* 49*b* as viewed in the waist-circumferential direction and passes through the guide ring 48 formed on the distal end of the first flap 47. Thereupon the flat cord 54 is folded forward so as to overlap the outer surface of the first flap 47. This flat cord 54 is covered with the press flap 50 underlapping an outermost sheet 4*a* of the waist portion 4. In this way, it is possible for the jacket 1 according to this invention to guide the flat cord 54 in the waist-circumferential direction substantially in the vertically middle area on the outer surface of the pocket 45 and/or the inner surface of the first flap 47 by receiving the flat cord 54 in the grooves 49*a,* 49*b.*

For emergency ascent, the jacket wearer may pull the press flap 50 backward in the waist-circumferential direction, i.e., in a direction indicated by an arrow P1 in FIG. 5, off from the first flap 47 and then pull the flat cord 54 forward in the waist-circumferential direction, i.e., in a direction indicated by an arrow P2 with the hand-grip 55 held in one hand. As a result, the flat cord 54 forces the first flap 47 upward to a position indicated by imaginary lines and opens the opening 46 of the pocket 45. As has already been described, the flat cord 54 is guided by means of the guide ring 48 and the grooves 49*a,* 49*b* so as to extend substantially in the vertically middle area, i.e., the middle area in a transverse direction of the first flap 47 on the inner surface of the first flap 47. Therefore, a force pulling the flat cord 54 is exerted on the vertically middle area of the first flap 47 so that the upper and lower areas defining the middle area therebetween can be evenly and reliably forced upward and the opening 46 of the pocket 45 can be quickly opened. The jacket wearer may further pull the flat cord 54, take the pouch 51 out from the pocket 45, take off the flat cord 54 from the opening 48*a* of the guide ring 48 and throw away the weight 60 together with the pouch 51 (See FIG. 4 also).

Figure 6:
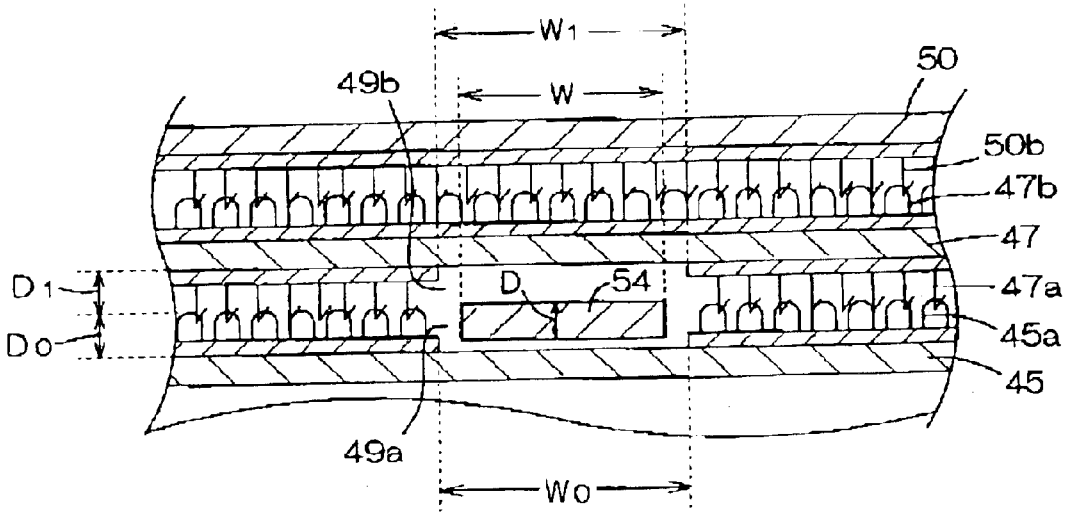
FIG. 6 is a sectional view taken along a line VI—VI in FIG. 1.
Figure 7:
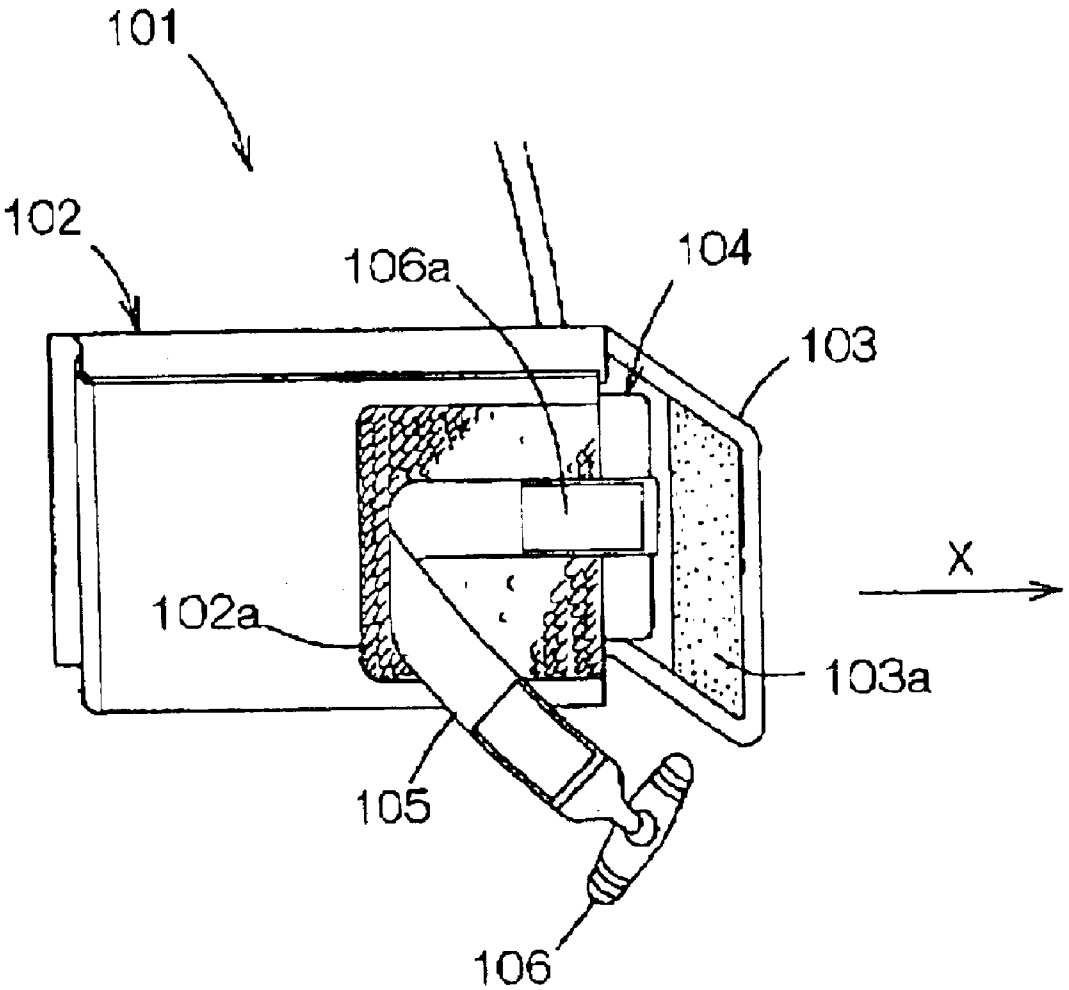
FIG. 7 is a plan view showing an example of the prior art.

FIG. 6 is a sectional view taken along a line VI—VI in FIG. 1 vertically extending through the press flap 50, illustrating important components of the pocket 45, specifically, those components of the pocket 45 lying in the vicinity of the flat cord 54. Neither the vertically opposite edges of the pocket 45 nor the innermost portion of the pouch 51 is illustrated.

The surface fastener 45*a* attached to the outer surface of the pocket 45 comprises a plurality of loop members while the surface fastener 47*a* attached to the inner surface of the first flap 47 comprises a plurality of hook members. The pocket 45 and the first flap 47 are separably integrated with each other by means of these surface fasteners 45*a*, 47*a*. The grooves 49*a,* 49*b* formed on the outer surface of the pocket 45 and the inner surface of the first flap 47, respectively, have dimensions $D_0$, $D_1$ as measured in the directions of their depths substantially equal to or larger than the thickness D of the flat cord 54 while the grooves 49*a,* 49*b* respectively have the dimensions $W_0$, $W_1$ corresponding to the widths thereof slightly larger than the width W of the flat cord 54. With such a dimensioning, once the flat cord 54 has been received in these grooves 49*a,* 49*b,* the surface fasteners 45*a*, 47*a* are brought in close contact with each other without being obstructed by the flat cord 54. Consequently, the first flap 47 can be closed without leaving any gap between these surface fasteners.

A surface fastener 47*b* attached to the outer surface of the first flap 47 comprises a plurality of loop members and a surface fastener 50*b* comprises a plurality of hook members. The first flap 47 and the press flap 50 are separably integrated with each other by means of these surface fasteners 47*b*, 50*b*. As will be apparent from the foregoing description, the jacket 1 has, in addition to the first flap 47 adapted to close the opening 46 of the pocket 45, the press flap 50 overlapping the first flap 47 so as to achieve a double security against falling off of the pouch 51 containing therein the weight 60 from the pocket 45.

It is possible to implement the jacket 1 so that the pocket 45 and the press flap 50 are provided on the right half or even each half of the waist portion 4 instead of being provided on the left halt of the waist portion 4.

While it is possible to guide the flat cord 54 substantially in the vertically middle area on the first flap 47 so far as the jacket 1 is provided on the first flap 47 with one of the guide ring 48 and the groove 49*b*, it is preferable to provide both the guide ring 48 and the groove 49 as illustrated. More preferably, the jacket 1 is also provided on the pocket 45 with the groove 49*a*.

The pocket 45, the first flap 47, the press flap 50 and the pouch 51 may be made of materials conventionally used in the prior art. The hand-grip 55 of the flat cord 54 maybe formed using plastic material, rubber or the like but a shape of the hand-grip 55 is not limited to that having been illustrated and described above.

The buoyancy compensating jacket according to this invention has the pocket comprising the substantially C-shaped guide ring formed at the distal end of the first flap in the substantially vertical middle and/or the groove formed on the inner surface of the first flap and/or the outer surface of the pocket in the substantially vertical middle, as the guide means for the flat cord of the pouch. The flat cord of the pouch containing therein the weight can be thereby guided on the inner surface of the first flap substantially in the vertically middle area and therefore the first flap can be reliably and quickly opened as the flat cord is pulled. Furthermore, once the flat cord has been received in the grooves serving as the guide means, the first flap can be closed without leaving any gap between the surface fasteners attached to the outer surface of the pocket and the inner surface of the first flap, respectively. In consequence, the first flap can be reliably fastened to the outer surface of the pocket.

The jacket including, in addition to the first flap, the press flap adapted to overlap the first flap achieves a double security against unintentionally falling off of the pouch.

What is claimed is:

1. A buoyancy compensating jacket comprising:

a back portion extending in a vertical direction;

a pair of shoulder portions extending downward from transversely opposite sides of an upper portion of said back portion;

a pair of waist portions extending forward in a waist-circumferential direction orthogonal to said vertical direction from transversely opposite sides of a lower end portion of said back portion and connected to said shoulder portions;

said back portion being provided with means adapted to fix an air cylinder and said waist portion being provided with at least one pocket extending in said waist-circumferential direction and having an opening at a forward end thereof in said waist-circumferential direction and a pouch having a flat cord and being adapted to be inserted into and taken out from said pocket with a weight packed into said pouch; and said pocket comprising a first flap extending backward in said waist-circumferential direction, a pair of surface fasteners releasably engaged with each other and provided on an inner surface or said first flap and an outer surface of said pocket respectively and a guide means provided on at least one of said first flap and said pocket so as to enable said flat cord of said pouch inserted into said pocket to extend outward from said pocket substantially in a vertically middle area on said inner surface of said first flap.

2. The buoyancy compensating jacket according to claim 1, wherein said guide means comprises a substantially C-shaped guide ring provided to a distal end of said first flap substantially in said vertically middle and having an opening backward in said waist-circumferential direction, and said guide ring has an inner diameter in said vertical direction larger than a width of said flat cord as measured in said vertical direction, and said opening is smaller than said width of said flat cord.

3. The buoyancy compensating jacket according to claim 1, wherein said guide means comprises a groove provided on at least one of said inner surface of said first flap and said outer surface of said pocket and defined between two sections of said surface fastener which are bisected and spaced from each other in said vertical direction, and a dimension of said groove in a depth direction thereof is substantially equal to or larger than a thickness of said flat cord.

4. The buoyancy compensating jacket according to claim 1, wherein said pocket is formed with both said guide means according to claim 2 and said guide means according to claim 3.

5. The buoyancy compensating jacket according to claim 1, wherein said pouch has an insertion opening for a weight at a forward end thereof in said waist-circumferential direction, a second flap adapted to open and close said insertion opening and flexible said flat cord extending in said waist-circumferential direction and adapted to be guided by said guide means and provided on a distal end thereof in said waist-circumferential direction with a hand-grip extending in a transverse direction of said flat cord beyond said width of said flat cord.

6. The buoyancy compensating jacket according to claim 1, wherein said waist portion is provided with a press flap adapted to overlap an outer surface of said first flap in a closed state and extending forward in said waist-circumferential direction, and said outer surface of said first flap and an inner surface of said press flap are adapted to be separably integrated with each other by means of a pair of surface fasteners attached to said surfaces.

7. The bouyancy compensating jacket according to claim 1, wherein said surface fasteners comprise loop members and hook members adapted to be releasably engaged one with another.

* * * * *